United States Patent [19]

Weber et al.

[11] Patent Number: 4,899,571

[45] Date of Patent: Feb. 13, 1990

[54] APPARATUS FOR DRAWING-IN A PIPE END BY COLD FORMING

[75] Inventors: Robert Weber, Uttenreuth; Helmut Mechtold, Nuremberg, both of Fed. Rep. of Germany

[73] Assignee: Siemens Aktiengesellschaft, Munich, Fed. Rep. of Germany

[21] Appl. No.: 222,270

[22] Filed: Jul. 21, 1988

[30] Foreign Application Priority Data

Jul. 22, 1987 [DE] Fed. Rep. of Germany ..... 3724309

[51] Int. Cl.[4] ..... B21D 41/04

[52] U.S. Cl. ..... 72/401; 72/402

[58] Field of Search ..... 72/393, 400, 402, 399, 72/401

[56] References Cited

U.S. PATENT DOCUMENTS

| | | | |
|---|---|---|---|
| 2,999,405 | 9/1961 | Ewart . | |
| 3,580,020 | 5/1971 | Bindernagel et al. | 72/393 |
| 3,731,518 | 5/1973 | Blocher . | |
| 3,795,035 | 3/1974 | Pogonowski . | |
| 3,888,103 | 6/1975 | Renshaw | 72/399 |
| 4,179,915 | 12/1979 | Huydts | 72/402 |
| 4,199,969 | 4/1980 | Engel et al. | 72/402 |
| 4,472,959 | 9/1984 | Fencl | 72/402 |
| 4,667,500 | 5/1987 | Mechtold et al. | 72/393 |

FOREIGN PATENT DOCUMENTS

| | | |
|---|---|---|
| 0154030 | 9/1985 | European Pat. Off. . |
| 2313787 | 10/1974 | Fed. Rep. of Germany . |

OTHER PUBLICATIONS

Bänder, Bleche, Rohre [Bands, Plates, Pipes] 4–1986, pp. 63–64, "Verfahren zum Umformen von Rohren" [Methods for Forming Pipes].

*Primary Examiner*—Robert L. Spruill

*Attorney, Agent, or Firm*—Herbert L. Lerner; Laurence A. Greenberg

[57] ABSTRACT

An apparatus for drawing-in a pipe end by plastic cold forming includes a clamping body. An annular body disposed on the clamping body has an inner surface and a center. An internal tool in the form of a stop ring is centrally supported on the clamping body for defining a desired inside pipe profile. A plurality of jaws is disposed on the clamping body for extending over the outside of a region of a pipe to be drawn-in. The annular body has blind bores serving as cylinders formed therein in radial directions with openings facing toward the inner surface of the annular body. Pistons connected to the jaws are inserted in the cylinders and movable radially toward the center of the annular body by a pressure medium. The stop ring has individual stops in the form of stop heads with threaded shafts being radially adjustably screwed into radial threaded bores formed in the stop ring. The threaded shafts may be rotated.

8 Claims, 4 Drawing Sheets

Figure 1:
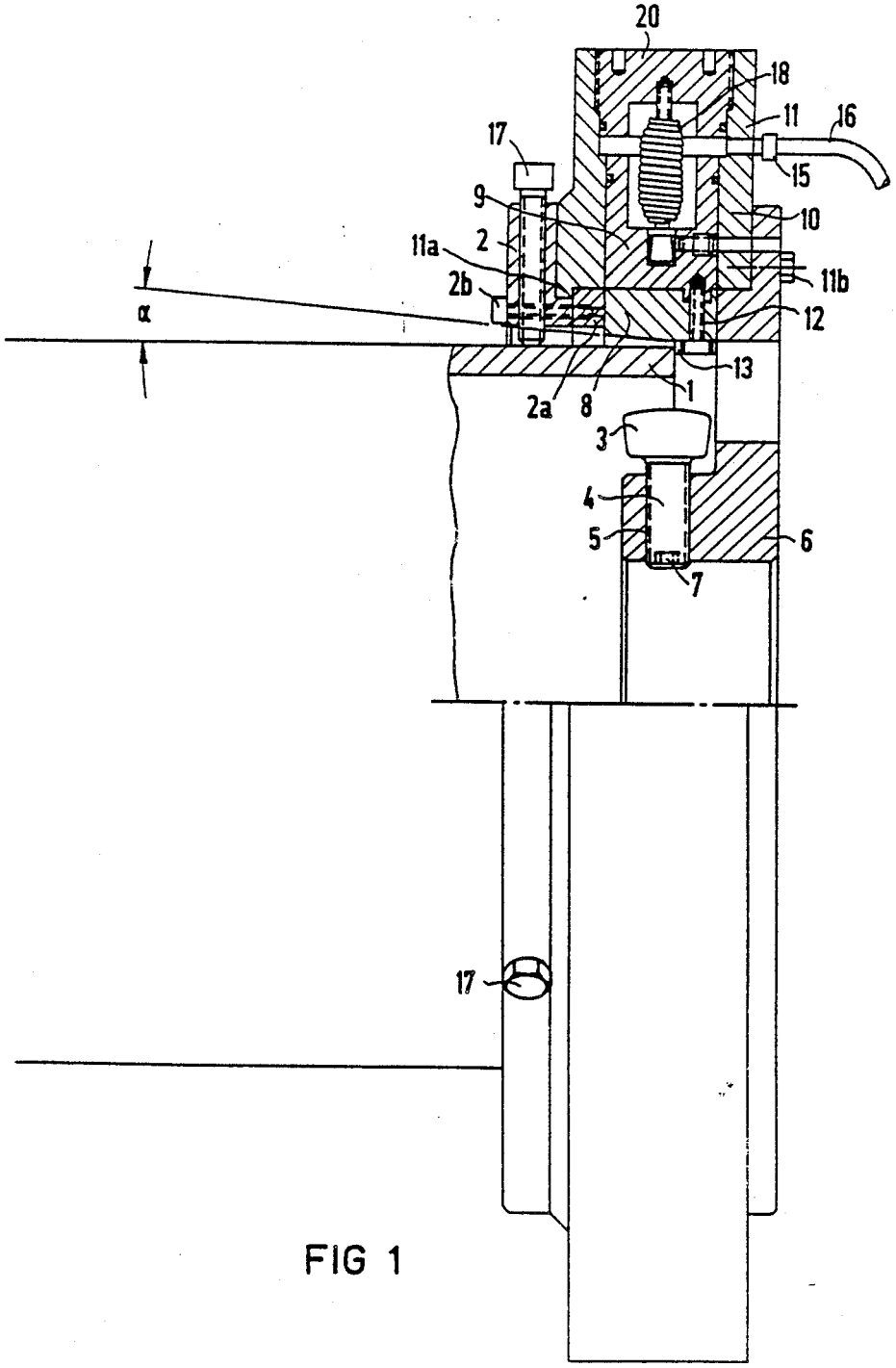

11
10
9
8
14
14
3
6
4
5

APPARATUS FOR DRAWING-IN A PIPE END BY COLD FORMING

The invention relates to an apparatus for drawing-in a pipe end by plastic cold forming or working, including a plurality of jaws extending over the outside of a region of a pipe to be drawn-in, and an inside tool dictating the desired internal profile of the pipe, being disposed on a clamping or supporting body.

Numerous different processes are known for forming the ends of tubular workpieces. During tapering performed by pressing the pipe inward into a tapering die, the pipe cross section can be reduced while the reduced portion is simultaneously elongated. The possible applications of such a method are limited by jumps in the initial cross section of the pipe, by bending, and by creasing in the vicinity of the taper.

According to another method, a deformation is performed by exerting external pressure on the pipe surface by means of a plurality of kneading jaws disposed over the circumference of the pipe. The internal longitudinal form which is produced is either free or bound. With bound forming, the inside surface assumes the shape of the internal tool, which may be cylindrical, conical or profiled (see the article entitled "Verfahren zum Umformen von Rohren" [Methods for Forming Pipes], in the journal "BÄNDER, BLECHE, ROHRE" [Bands, Plates, Pipes] 4-1986, pages 63 and 64).

Stationary machinery or equipment is necessary for using these known methods This means that the work must be performed in a shop.

For the assembly of pipelines, especially in power plants, chemical plants, offshore installations and the like, high quality is demanded of the joining points of pipes, arches, supports and other tubular components that must be welded, and only a narrow tolerance in terms of edge offset is allowable.

It is accordingly an object of the invention to provide an apparatus for drawing-in a pipe end by cold forming, which overcomes the hereinafore-mentioned disadvantages of the heretofore-known devices of this general type, which is usable on-site for drawing-in a pipe end by cold forming, which is simple in construction and which is usable for various pipe diameters With this apparatus, it should be possible to prepare the joining points in such a way that they fit precisely to one another dimensionally.

With the foregoing and other objects in view there is provided, in accordance with the invention, an apparatus for drawing-in a pipe end by plastic cold forming or working, comprising a clamping body, an annular body disposed on the clamping body having an inner surface and a center, an internal tool in the form of a stop ring centrally supported on the clamping body for specifying a desired inside pipe profile, a plurality of jaws disposed on the clamping body for extending over the outside of a region of a pipe to be drawn-in, the annular body having blind bores serving as cylinders formed therein in a star pattern with openings facing toward the inner surface of the annular body, and pistons connected to the jaws being inserted in the cylinders and movable radially toward the center of the annular body by a pressure medium, the stop ring having individual stops in the form of stop heads with threaded shafts being radially adjustably screwed into radial threaded bores formed in the stop ring, and the threaded shafts having ends with means for rotating the threaded shafts In this way, the ends of pipes, and in particular the inside diameters thereof, can be very precisely adapted dimensionally to one another at the joining points, and precision on the order of tenths of millimeters are attainable on-site.

In accordance with another feature of the invention, there are provided means for connecting the stop ring to the annular body and for releasing the stop ring from the annular body. In other words, the stop ring forming the internal tool is detachable from the annular body. This makes it possible to use the apparatus selectively without the internal stop ring, in which case the shape of the pipe end upon being drawn-in is formed freely in accordance with an added feature of the invention, the jaws have surfaces acting upon the pipe end, the surfaces forming an acute angle with the outer surface of the pipe, opening in a direction facing away from the pipe end as seen along the axis of the pipe. In this way, the drawing-in forces can be kept quite low. The pipe end is drawn inward during the drawing-in process in a negative or inward tulip-like shape, the shape being freely formed and determined by the wall thickness of the pipe and by the material of the pipe. It is particularly advantageous if, in accordance with an additional feature of the invention, the angle is smaller than an angle of friction between the jaws and the outer surface of the pipe.

In accordance with still another feature of the invention, there are provided conduits disposed in the annular body and interconnecting the individual cylinders for delivery of pressure medium, and attachment means associated with at least one of the cylinders having a flexible line for connection to a pressure medium generator. This embodiment provides a simple and lightweight construction of the apparatus, which makes on-site manipulation much easier.

In accordance with still a further feature of the invention, there are provided restoring springs biasing the pistons.

In accordance with still an added feature of the invention, there is provided at least one pressure booster mounted on at least one of the pistons.

In accordance with a concomitant feature of the invention, the annular body is rotatably supported on the clamping body, and the clamping body has clamping screws.

Other features which are considered as characteristic for the invention are set forth in the appended claims.

Although the invention is illustrated and described herein as embodied in an apparatus for drawing-in a pipe end by cold forming, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figures 2, 2A, 2B:
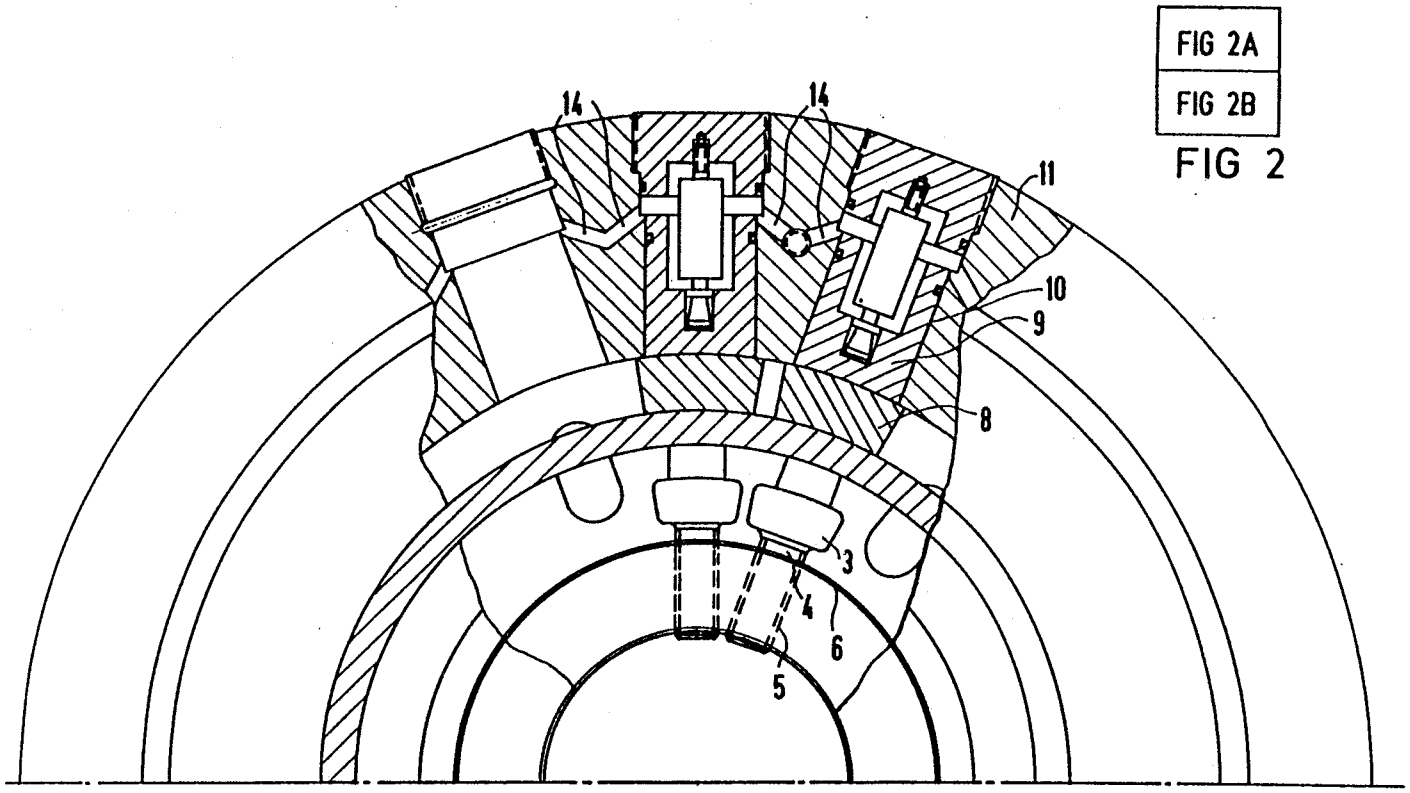
Figure 2B:
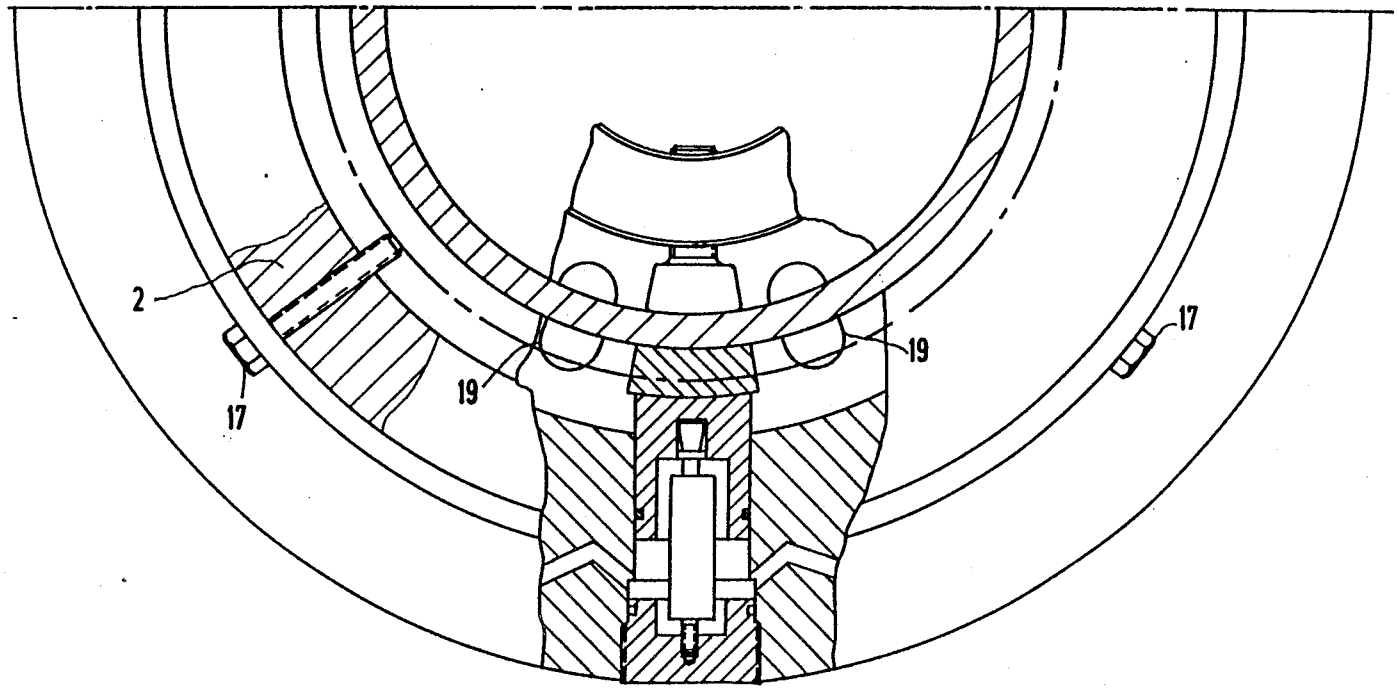
Figure 3:
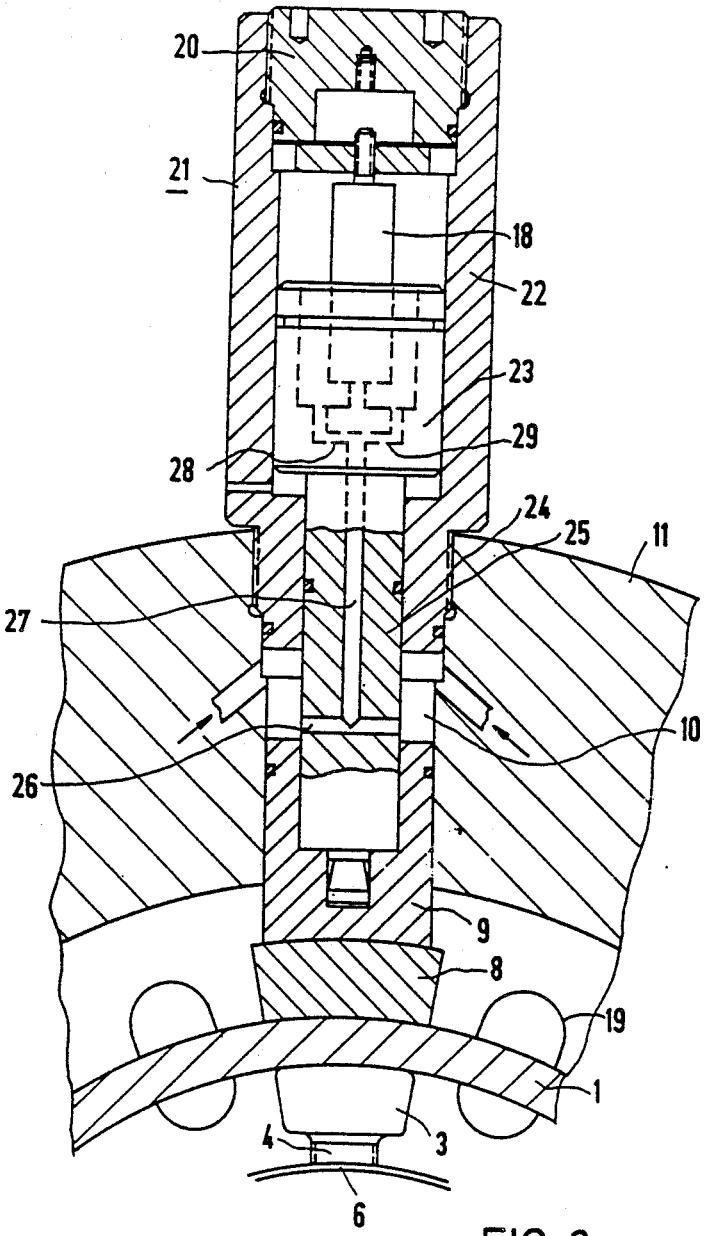

FIG. 1 is a fragmentary, partially sectional, side-elevational view of an apparatus for drawing-in a pipe end;

FIG. 2A is a fragmentary, partly broken-away, sectional view of FIG. 1 showing the location of the piston prior to drawing-in and FIG. 2B is another fragmentary, partly broken-away, sectional view showing the location of the piston after the drawing-in of the pipe end, FIGS. 2A and 2B forming parts of FIG. 2 in the disposition shown in the legend in FIG. 2A; and FIG. 3 is a fragmentary sectional view of an apparatus having a booster mounted thereon.

Referring now to the figures of the drawing in detail and first, particularly, to FIG. 1 thereof, there is seen an apparatus for drawing-in the end of a pipe 1, in which an annular body 11 having pistons 9, and a stop ring 6 constructed as an internal tool having individual stops, are rotatably disposed on a clamping or supporting body 2. The individual stops are in the form of stop heads 3 having threaded shafts 4. As shown in FIG. 2 as well, the threaded shafts 4 are disposed in radial threaded bores 5 in the stop ring 6 so as to be rotatable into a desired location. Means for rotating the threaded shaft are attached at each shaft end. In the illustrated embodiment, a polygonal socket 7 several for rotation, and a ratchet socket wrench can be inserted into the socket in order to perform a continuous adjustment of the height of the stop heads 3. The surfaces of the stop heads 3 oriented toward the inner surface of the pipe are crowned and preferably have the form of a spherical surface.

The annular body 11, which is centrally retained on the stop ring 6, has blind bores that are open toward the inside and are disposed in a star pattern, so as to serve as cylinders 10. A plurality of jaws 8 which extend over the outside of the portion of the pipe 1 to be drawn-in, are provided on the inside of the annular body 11 and serve as pressing dies. Each jaw is connected to a respective piston 9. The pistons are guided in the blind bores or cylinders 10 in the annular body 11, which are disposed radially and are as close as possible to one another. The jaws 8 are secured to each of the pistons 9 with screws 12 and the jaws each have a shoulder 13, which serves as a stop for the end of the pipe 1 in the apparatus. The pistons 9 are each provided with a restoring spring 18, one end of which is secured to the piston 9 and the other end of which is secured to a plug 20, which can be screwed into the cylinder 10 and tightly closes it off on the side opposite the jaw 8. This embodiment permits a particularly simple production.

The individual cylinders 10 are connected with one another by means of conduits 14 for supplying a pressure medium, as seen in FIG. 2A. At least one of the cylinders 10 is provided with attachment means 15, for instance in the form of a quick-connect pipe union, for a line 16 leading to a generator for the pressure medium, as seen in FIG. 1. If the pistons 9 are subjected to pressure medium, then the jaws 8 that come into contact with the outer surface of the pipe press the pipe end inward and thereby reduce the outer and inner diameters of the pipe end, as seen in FIG. 2B. The jaws 8 can have various shapes, depending on the desired profile of the pipe end. The surfaces of the jaws 8 that act upon the pipe end preferably form an acute angle $\alpha$, which opens in the direction facing away from the pipe end, as seen along the pipe axis. The angle $\alpha$ is preferably smaller than the angle of friction between the jaws 8 and the outer surface of the pipe 1. For steel pipes, the angle $\alpha$ is approximately 5°.

In order to be able to attain a predetermined diameter, and in particular an inside diameter, in an accurate and replicable manner, preferably the number of stop heads 3 is the same as the number of jaws 8.

The annular body 11 which is rotatably supported on the clamping body 2 has an inner flange 11*a*, which is guided in sliding surfaces of a ring 2*a* and of the clamping body 2. The ring 2*a* is retained on the clamping body 2 with screws 2*b*, so that the apparatus can also be used without clamping bodies 2 by loosening the screws 2*b*.

Prior to drawing-in a pipe, the individual stop heads 3 are all adjusted to the same set dimension, so that the desired inside diameter for the pipe is specified. A coarse adjustment for the pipe 1 is performed by means of clamping screws 17 that are disposed on the clamping body 2. The circular arc described by the tips of the clamping screws 17 is set to be somewhat larger than the outside diameter of the pipe, for pre-centering purposes. The movable line 16 is connected to a hand pump having a relief valve which is initially open, so that the restoring springs 18 can retract the pistons 9 with the jaws 8 screwed on, into the location shown in FIG. 1, should this not yet have occurred. The apparatus is then ready for slipping onto the end of the pipe 1. The shoulder 13 limits the depth to which the apparatus can be slipped on. The clamping screws 17 are then rotated inward until such time as they retain the pipe drawing-in apparatus by frictional engagement on the pipe end.

The relief valve at the hand pump can then be closed, and the apparatus can be subjected to pressure by actuation of the hand pump, until the inside pipe surface rests uniformly on all of the stop heads 3, as seen in FIG. 2B. For visual monitoring, observation ports 19 are provided in the stop ring 6.

Once the valve on the hand pump is opened again, the restoring springs 18 retract the jaws 8 back into the initial position. The apparatus could therefore be pulled back off the pipe, but the clamping screws 17 would have to be loosened. However, in order to attain a very precise inside diameter of the pipe 1, it is advantageous to rotate the apparatus by approximately one half-jaw width or a multiple thereof in the circumferential direction, and to subject the apparatus once again to pressure, until the inside pipe surface once again rests on the stop heads 3. The accuracy of the cold forming can be even further increased by this provision. Recoiling effects can be compensated for by means of a material-specific correction constant in the set dimension.

In cases in which very great precision in terms of the inside diameter of the pipe is not necessary, the stop ring 6 can be removed from the annular body 11 by loosening the screws 11*b*.

With thin pipe wall thicknesses, an unintended creasing can be produced by the drawing-in process. In order to avoid this, it is advantageous to operate the apparatus with a force amplifier, known as a booster.

As shown in FIG. 3, a booster 21 of this kind can be mounted upon one or more or all of the pistons 9, in a force-amplifying manner. A cylinder 22 having a piston 23 is screwed into the upper opening 24 in the cylinder 10 disposed in the annular body 11, and the piston 23 can be connected to the piston 9 by a piston rod 25. The piston rod 25 is provided with bores 26, 27, through which the pressure medium introduced into the cylinder 10 passes into conduits 28, 29 and from there reaches the chamber of the cylinder 22.

When boosters are used, a hydraulic unit is suitably used as the pressure medium generator.

The use of boosters can also be necessary if the drawing-in forces of the apparatus are no longer adequate because the wall of the pipe is thick In that case the boosters impose additional individual forces upon the pipe periphery, so that the pipe end can be pressed-in at the periphery. A circular pipe cross section is regained by rotation of the annular body 11 with the stop ring 6 and by repeated pressing.

The foregoing is a description corresponding in substance to German Application No. P 37 24 309.8, dated July 22, 1987, the International priority of which is being claimed for the instant application, and which is hereby made part of this application. Any material discrepancies between the foregoing specification and the aforementioned corresponding German application are to be resolved in favor of the latter.

We claim:

1. Apparatus for drawing-in a pipe end by plastic cold forming, comprising a clamping cody, an annular body disposed on said clamping body and having an inner surface and a center, an internal tool in the form of a stop ring centrally supported on said annular body for defining a desired inside pipe profile, a plurality of jaws disposed on said annular body for extending over the outside of a region of a pipe to be drawn-in, said annular body having blind bores serving as cylinders formed therein in radial directions with openings facing toward said inner surface of said annular body, and pistons connected to said jaws being inserted in said cylinders and movable radially toward the center of said annular body by a pressure medium, said stop ring having individual stop means in the form of stop heads for abutting the inner surface of the pipe during a drawing-in operation, said stop heads having threaded shafts being radially adjustably screwed into radial threaded bores formed in said stop ring, and said threaded shafts having ends with means for allowing rotation of said threaded shafts.

2. Apparatus according to claim 1, including means for connecting said stop ring to said annular body and for releasing said stop rings from said annular body.

3. Apparatus according to claim 1, wherein said jaws have surfaces acting upon the pipe end, said surfaces forming an acute angle with the outer surface of the pipe, opening in a direction facing away from the pipe end as seen along the axis of the pipe.

4. Apparatus according to claim 3, wherein said angle is smaller than an angle of friction between said jaws and the outer surface of the pipe.

5. Apparatus according to claim 1, including conduits disposed in said annular body and interconnecting said cylinders for delivery of pressure medium, and attachment means associated with at least one of said cylinders having a flexible line for connection to a pressure medium generator.

6. Apparatus according to claim 1, including restoring springs biasing said pistons.

7. Apparatus according to claim 1, including at least one pressure booster mounted on at least one of said pistons.

8. Apparatus according to claim 1, wherein said annular body is rotatably supported on said clamping body, and said clamping body has clamping screws.

* * * * *